United States Patent [19]

Abramson

[11] 4,275,526

[45] Jun. 30, 1981

[54] THERMAL-BREAK WINDOW

[76] Inventor: Harold B. Abramson, 30 Stearns Rd., Brookline, Mass. 02146

[21] Appl. No.: 69,531

[22] Filed: Aug. 24, 1979

[51] Int. Cl.[3] ..... E06B 3/00

[52] U.S. Cl. ..... 49/501; 49/504; 49/DIG. 1; 52/207; 52/731

[58] Field of Search ..... 49/501, 504, DIG. 1; 52/732, 207, 731

[56] References Cited

U.S. PATENT DOCUMENTS

| | | | |
|---|---|---|---|
| 3,204,324 | 9/1965 | Nilsen | 49/DIG. 1 |
| 3,436,885 | 4/1969 | Rothermel | 52/207 |
| 3,844,077 | 10/1974 | Vance | 52/732 X |
| 4,064,653 | 12/1977 | Randall et al. | 49/DIG. 1 X |

*Primary Examiner*—Kenneth Downey

*Attorney, Agent, or Firm*—Morse, Altman, Oates & Dacey

[57] ABSTRACT

A thermal-break window of extruded frame members interconnected to form a substantially rectangular frame for encasing a glass panel in which each of the frame members is formed with a channel along its axial length. This channel contains a material of low thermal conductivity hardened in situ and with a strip of the extruded material along the channel being removed, effectively separating thereby each of the extruded frame members into two sections along their entire lengths, representing exterior and interior sections, that remain joined only by the material of low thermal conductivity. Consequently, the exterior frame sections are and remain thermally insulated from the interior frame sections. Furthermore, certain of the extruded frame members are designed to snap-fit to one another, providing for ease and simplicity in assembly.

13 Claims, 15 Drawing Figures

THERMAL-BREAK WINDOW

BACKGROUND OF THE INVENTION

1 . Field of Invention

The present invention relates to windows and more particularly is directed to a thermal-break window fabricated of a plurality of extruded frame members designed, when interconnected, to form a substantially rectangular frame for encasing a glass panel.

2. Description of the Prior Art

Windows of various configurations have previously been made from a plurality of precut extruded sections that were fastened together by welding and/or by fasteners, e.g., screws, nuts and bolts or the like. All these windows have been suffered from the disadvantages of complex and costly fabrication and assembly techniques. Furthermore, all these prior windows possessed an undesirable characteristic, namely that of conducting heat or cold from the outside atmosphere through their metal frame members into the room, thus not being energy efficient.

SUMMARY OF THE INVENTION

It is a principal object of the present invention to provide a thermal-break window that is energy-efficient in that it thermally insulates the exterior portion of the window from its interior portion. More specifically, it is an object of the present invention to provide a thermal-break window of extruded frame members interconnected to form a substantially rectangular frame for encasing a glass panel in which each of the frame members is provided with a channel along its axial length. This channel contains a material of low thermal conductivity hardened in situ and with a strip of the extruded material along the channel being removed, separating thereby each of the extruded frame members into two sections along their entire lengths, respresenting exterior and interior sections, that remain joined only by the material of low thermal conductivity, thermally insulating thereby the exterior from the interior sections. Furthermore, it is an object of the present invention to provide a thermal-break window of extruded frame members in which certain of the members are designed to snap-fit to each other, making for ease and simplicity of assembly. It is a still further object of the present invention to provide an improved method of fabricating and assembling a thermal-break window of precut extruded frame members designed, when interconnected, to form a substantially rectangular frame for encasing a glass panel comprising extruding the frame members with a channel along their axial lengths, filling the channel with a material of low thermal conductivity, allowing the material of low thermal conductivity to become hardened in situ, and removing a strip of the extruded material along the channel. As a consequence, each of the extruded frame members is effectively separated into two sections along its entire length, representing exterior and interior sections, that remain joined only by the material of low thermal conductivity. As a further consequence, the exterior sections are and remain thermally insulated from the interior sections, resulting in an energy-efficient window of high durability yet of relative simplicity.

Other objects of the present invention will in part be obvious and will in part appear hereinafter.

The invention accordingly comprises the product and the method that are exemplified in the following disclosure, the scope of which will be indicated in the appended claims.

BRIEF DESCRIPTION OF THE DRAWINGS

A fuller understanding of the nature and objects of the present invention will become apparent upon consideration of the following description taken in connection with the accompanying drawings, wherein.

DETAILED DESCRIPTION OF THE PREFERRED EMBODIMENTS

Figure 1:
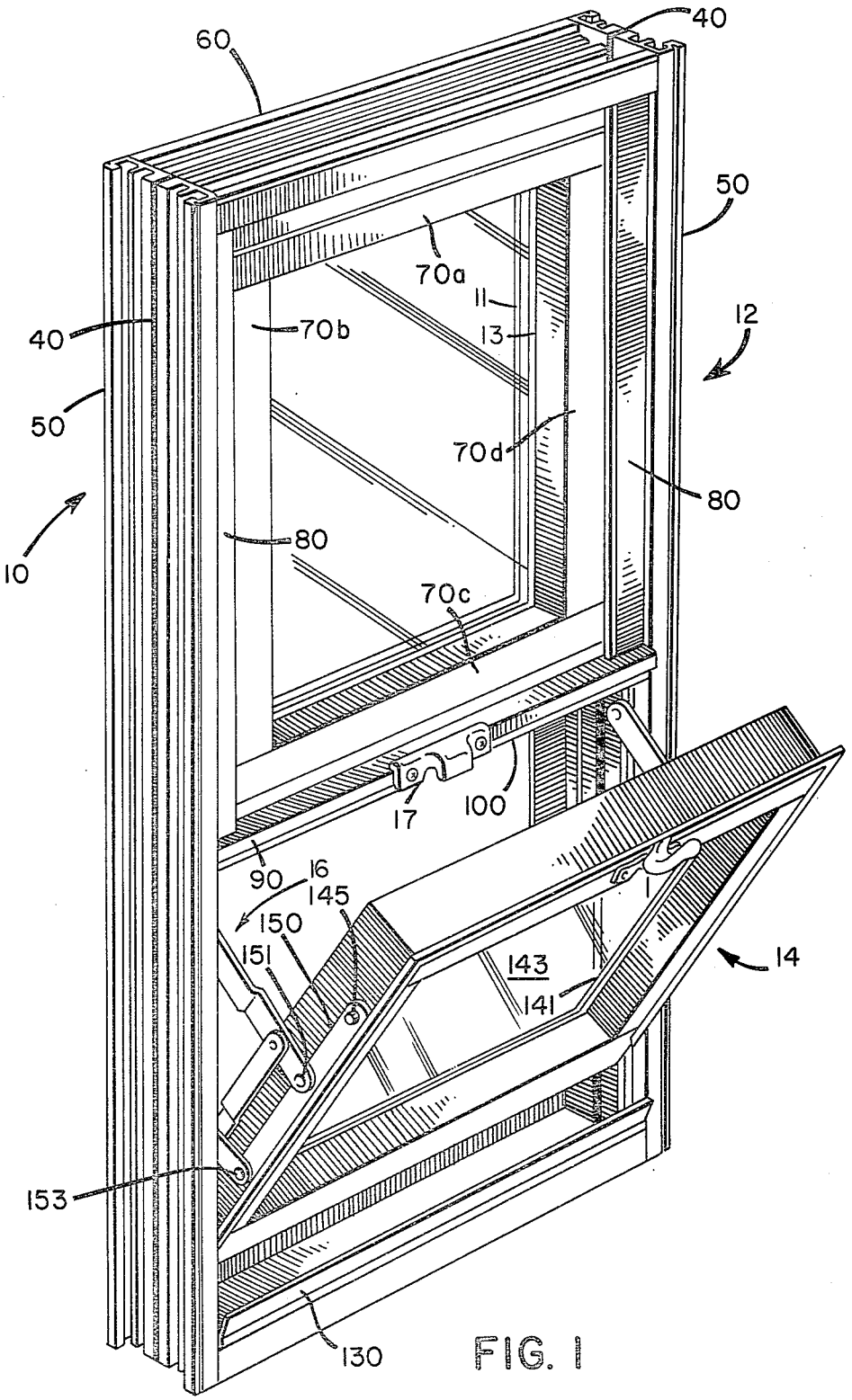
FIG. 1 is a perspective view of a thermal-break window constructed in accordance with and embodying the present invention and consisting of a top fixed window section and of a bottom hopper-style window section.

Referring to the drawings, particularly to FIG. 1, there is depicted a thermal-break window 10 in perspective, consisting of a top fixed window section 12 and of a bottom hopper-style window section 14 shown in the open position. Both sections comprise a plurality of members that are extrusion formed of a suitable metal, such as aluminum alloy, and then cut to predetermined lengths. Preferably, the aluminum alloy consists essentially of approximately 0.4 percent silicon, 0.7 percent magnesium and 98.9 percent aluminum and having an aluminum Associated alloy designation 6063-T5 as specified in the Aluminum Associated Standardized System of Alloy Designation adopted in October 1954. The aluminum alloy furthermore preferably has an ultimate tensile strength of not less than 22,000 pounds per square inch. Consequently, the window of the invention is a high performance window that can be properly fitted into mid-rise (17 to 20 stories) buildings. Also preferably, the extruded members of the window of the invention are provided with a hard, highly resistant coating, such as exemplified by the PPG Duracron electrostatic acrylic paint. The extruded frame members are interconnected to form a substantially rectangular frame for encasing a glass panel, which preferably comprises insulating glass of the kind having an exterior 11 and an interior 13 panel with an air space sealed therebetween. In the hopper-style window, these panels are designated by the numerals 141 and 143, respectively. Project-in ventilator windows, project-out ventilator windows 24 and casement right-hand 34 and left-hand type (not shown) windows are designed to open on balance arms 16 having adjustable sliding pivots, with non-abrasive friction shoes and concealed adjustable compression springs, all as well understood to those skilled in the art and hence not shown. These ventilator and casement type windows may be conveniently secured in the closed position by a suitable handle 15 movable within and cooperating with a mating notch opening 17, all as is well known to those skilled in the art.

Figure 4:
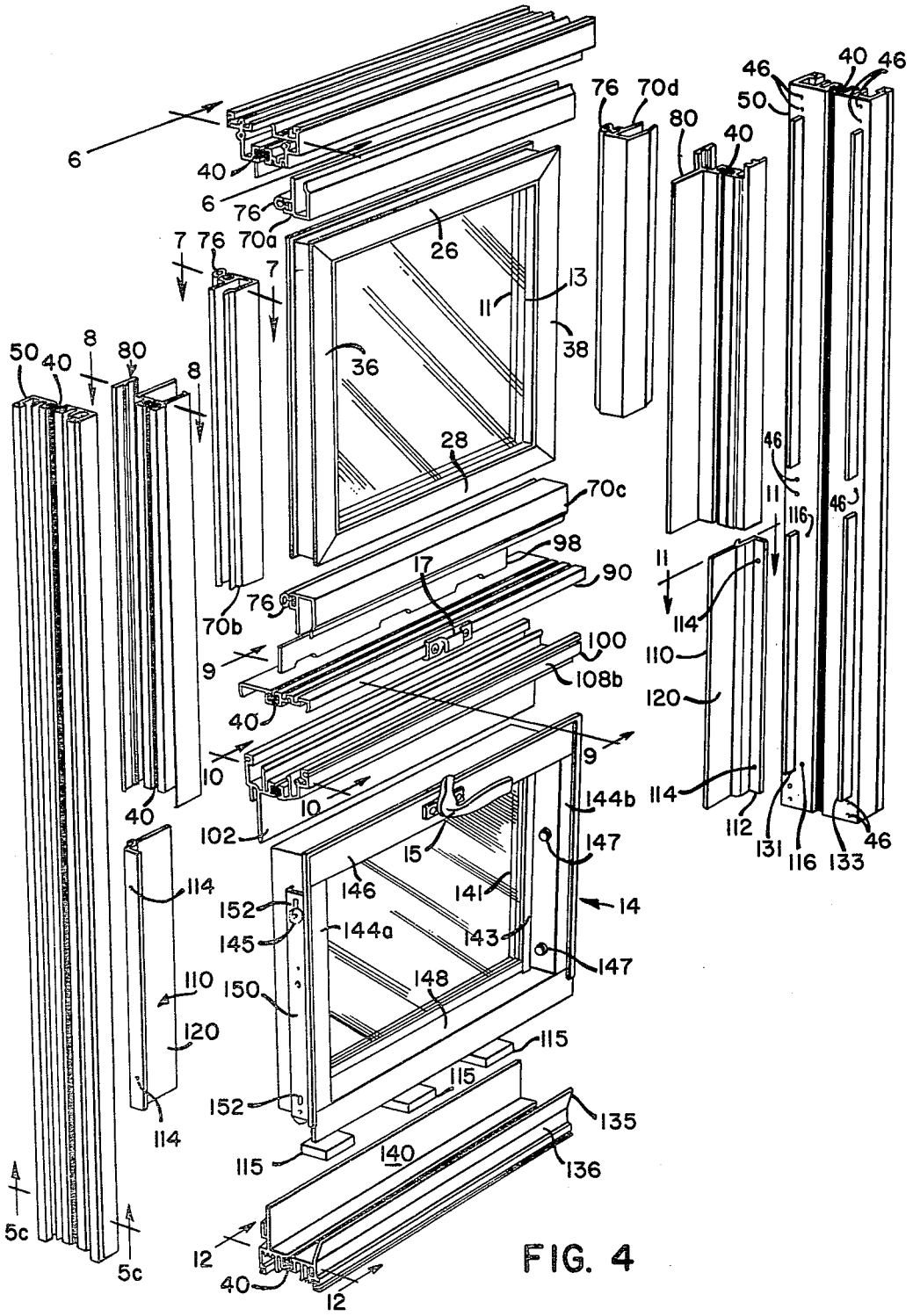
FIG. 4 is an exploded view in perspective of the thermal-break window shown in FIG. 1 but with the bottom hopper-style window shown in the closed position and omitting the balance arms thereof for purposes of clarity.

The insulating glass composed of panels 11 and 13 may conveniently be snapped within top and bottom rails 26 and 28, and left and right side rails 36 and 38, respectively, as may be observed in FIG. 4. These four rails, with the insulating glass therebetween, may then be conveniently secured to one another by corner clamps, all as well known and hence not shown. Of course, these rails are also preferably extrusion formed and cut to the desired lengths.

In the embodiment shown in FIGS. 1 and 4, it will be seen that the extruded frame members include a pair of vertical side jambs 50, 50, a pair of vertical jamb adaptors 80, 80 designed to snap-fit to the side jambs as will be more fully described below and required only in the construction of a fixed window section 12, a pair of vertical glazing beads **70*b* and 70*d* also designed to snap-fit to the jamb adaptors and required only for a fixed window section 12, a horizontal head and sill member 60 and its corresponding horizontal glazing bead 70*a* again designed to snap-fit to each other, and a horizontal head and sill adaptor 90 with its snap-fitting horizontal glazing bead 70*c***.

It will be observed that the insulating glass held within horizontal rails 26 and 28 and vertical side rails 36 and 38 is engaged on the interior side by the horizontal and vertical glazing beads **70*a*, 70*b*, 70*c* and 70*d*, more particularly by a deformable vinyl bulb 76 of extruded tubular configuration insertable within an appropriate mortise formed in each of the glazing beads, as more particularly described below. On the exterior side, the insulating glass is engaged by suitable flanges formed integral with the vertical jamb adaptors 80, 80 and with the horizontal head and sill member 60 on the top and the horizontal head and sill adaptor 90** at the bottom.

The horizontal head and sill member 60 and head and sill adaptor 90 may conveniently be secured to and within the pair of vertical side jambs 50, 50 by screws passing through holes 46 provided in the jambs 50, 50 as may be best observed in FIG. 4.

It will be noted that the frame members required for the ventilator-type windows, save for the provision of the same pair of vertical side jambs 50, 50, are different from the frame members required for the construction of the fixed-type windows, all of course as is well known to those skilled in the art. For instance, in lieu of the vertical jamb adaptors 80, 80 and the glazing beads **70*b* and 70*d*, a pair of vertical glazing legs 110, 110 are provided, that may be conveniently secured to their respective jambs 50,50 by screws passing through holes 114 in the glazing legs 110, 110 and matching holes 116 in the side jambs 50, 50. The horizontal frame sill 100 is also designed to snap-fit with head and sill adaptor 90 and is provided with an integral flange 102 that, together with the pair of vertical glazing legs 110, 110 and an integral flange 140 of the bottom horizontal frame head 130 provide one of the double contacts between the frame and the ventilator sections. The other of the double contacts is provided by the interior edges of the vertical side rails 144*a* and 144*b* and of the horizontal rails 146 and 148, which edges are designed to abut against suitable interior projections 133 formed integral with the side jambs 50 and against an interior wall 106*b* of the frame sill 100. Both of these double-contact surfaces are preferable provided with extruded vinyl weather-stripping held securely within suitable recesses formed in the extruded metal portions, all as is well understood by those skilled in the art. In order to facilitate the opening and closing of the hopper-type window section 14, the bottom frame head 130 is provided with an inclined portion 135; while a plurality of soft plastic sponge pads 115 may be adhesively bonded to the inner side of the frame head 130 against which the window section 14** may seat when in the closed position.

The previously mentioned balance arms 16 may be pivotally secured as at 151 and 153 to a suitable mounting strip 150 mounted to the vertical sides of the window section 14 by nuts 145 and bolts 147. One should note the provision of slots 152, 152 in the mounting strip 150 by which the relative position of the pivot points 151 and 153 may be slidably adjustable.

In addition to the special design of certain of the extruded frame members of the window of the invention which permits them to be snap-fitted to each other during assembly, an important feature of the invention resides in the provision of forming the frame members, as more fully described below, of two halves substantially along their axial lengths, representing exterior and interior portions, that are joined to each other by a strip of material characterized in that the material possesses a low thermal coefficient, thermally insulating thereby the exterior from the interior portions. This insulating material of low thermal conductivity may be any suitable elastomeric material of the thermoset variety which may be introduced into a channel formed in the extruded metal member in liquid form and may then be permitted to become hardened in situ either by the well known thermoset technique or by any other appropriate technique, as known to those skilled in the art. In addition to its thermal insulating property, expressed by having a low thermal coefficient, this material, when hardened, must possess physical properties similar to those of the extruded metal frame members, in particular with respect to tensile strength. Epoxy resins and their polymers have been found to be suitable. Other like materials will readily suggest themselves to those skilled in the art or may become known hereafter.

Figure 5A:
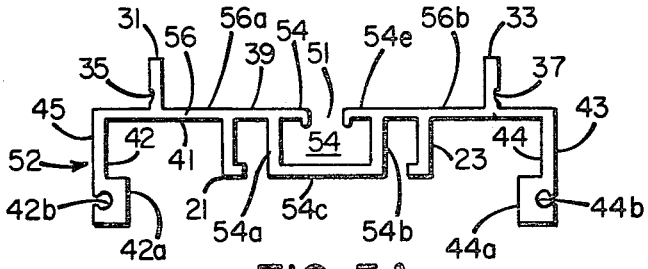
FIG. 5A is a view similar to that of FIG. 5C but showing the jamb as it appeared when extrusion formed.
Figure 5B:
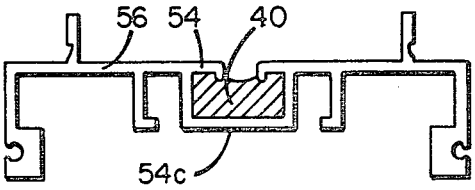
FIG. 5B is also a view similar to that of FIG. 5C but showing the jamb as it appeared after being extrusion formed and its central U-shaped channel filled with a material of low thermal conductivity permitted to become hardened in situ.
Figure 5C:
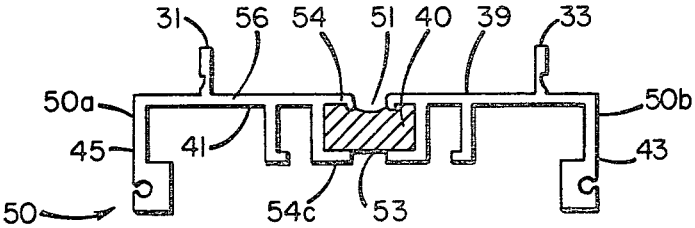
FIG. 5C is a sectional view of the left vertical side jamb taken along the lines 5—5 of FIG. 4.

The method of fabricating the frame members of a thermal-break window is illustrated in and may be best described with references to FIGS. 5A 5B and 5C. FIG. 5A is a sectional view of a vertical side jamb as extrusion formed 52 and comprises a base 56 formed of two segments **56*a* and 56*b* with an axial gap 51 separating these two segments from one another. A pair of legs 42 and 44 are formed at the respective ends of the base segments 56*a* and 56*b* and are parallel to one another and normal to the base 56. Legs 42 and 44 terminate in strengthened portions 42*a* and 44*a* respectively and having mortises 42*b* and 44*b* respectively formed therein, by means of which the side jambs may be conveniently secured within a wall of a building. A central U-shaped channel 54 is formed along the axial length of the extruded frame jamb 52 whose parallel side walls 54*a* and 54*b* connect with and are normal to the respective segments 56*a* and 56*b* of base 56, with an outer wall 54*c* containing with side walls 54*a* and 54*b* and being parallel with base 56**.

As is evident from viewing FIG. 5A, these walls **54*a*, 54*b* and 54*c* provide the interconnecting link between the two segments 56*a* and 56*b* of the base 56, thus effectively bridging the axial gap 51 therebetween. A pair of parallel projections 31 and 33 are formed also normal to the base 56, one on each segment 56*a* and 56*b* and in a direction opposite to and offset from the legs 42 and 44. It should be noted that projections 31 and 33 are provided with side depressions 35 and 37 respectively that extend along their lengths, the significance of which will become more apparent when describing below their being snap-fitted to jamb adaptor 80. A pair of reinforcing ribs 21 and 23 and also preferably provided to give the jamp added structural strength and also aid in its anchoring to a building wall, such as a masonry wall. These ribs 21 and 23 are formed in spaced parallel relation to the side walls 54*a* and 54*b* of the central U-shaped channel 54. It should be noted that side jamb 52 has a substantially U-shaped profile in right cross section and includes an inner side 39, an outer side 41, an interior side 43 and an exterior side 45. For purposes of better understanding, it should be noted that the sides denoted as the inner sides of the extruded frame members of the thermalbreak window of the invention face one another, with the insulating glass panels 11 and 13** being in juxtaposition the inner sides. The outer sides are opposite to the inner sides and face the wall portions surrounding the window when installed in a building wall. The exterior sides are on the outside of the window and exposed to the atmosphere when placed in an outside wall, while the interior sides are on the inside of the window opposite to the exterior sides and face the particular enclosed space surrounded by the walls of the building.

FIG. 5B is a view similar to that shown in FIG. 5A but showing the jamb with its central U-shaped channel 54 acting as a mold and as such filled with a material 40 of low thermal conductivity permitted to become hardened in situ. The filling of the channel 54 with the material 40 may be accomplished in the art. FIG. 5C is a sectional view of the jamb 50 taken along the lines 5—5 of FIG. 4 and, as may be observed is a view similar to FIG. 5B and in fact differs therefrom in only one respect, namely that a strip 53 of the extruded outer wall **54*c* of channel 54 along its entire axial length and opposite to the axial gap 51 has been removed, as by being machined out in any suitable machine. As a result, the side jamb 50 has now been effectively separated into two sections along its entire length, representing an exterior half section 50*a* and an interior half section 50*b*, that remain joined only by the material 40 hardened in place. Hence, the metallic connection between the exterior side 45 and the interior side 43 has been effectively broken and replaced in one segment by a thermally insulating barrier in the form of this material 40 possessing a low thermal coefficient. Consequently, temperature transfer due to metallic conductivity from the exterior side 45 to the interior side 43 has been reduced to a negligible minimum, making for an energy-efficient window construction. It will be apparent from a view of FIG. 4 that the extrusion- formed frame members designed to be interconnected to form a substantially rectangular frame for encasing a glass panel are each formed with a similar channel along their axial lengths, and that this channel contains a material 40 of low thermal conductivity hardened in situ and with a strip of the extruded material along the channel being removed so as to effectively separate each of these extruded frame members into two halves along their respective entire lengths, representing exterior and interior portions, that remain joined only by the material 40** possessing a low thermal coefficient, thermally insulating thereby the exterior of the window from its interior and thus minimizing temperature transfer, be it hot or cold, from the exterior to the interior. These extrusion formed frame members will now be described in greater detail.

Figure 6:
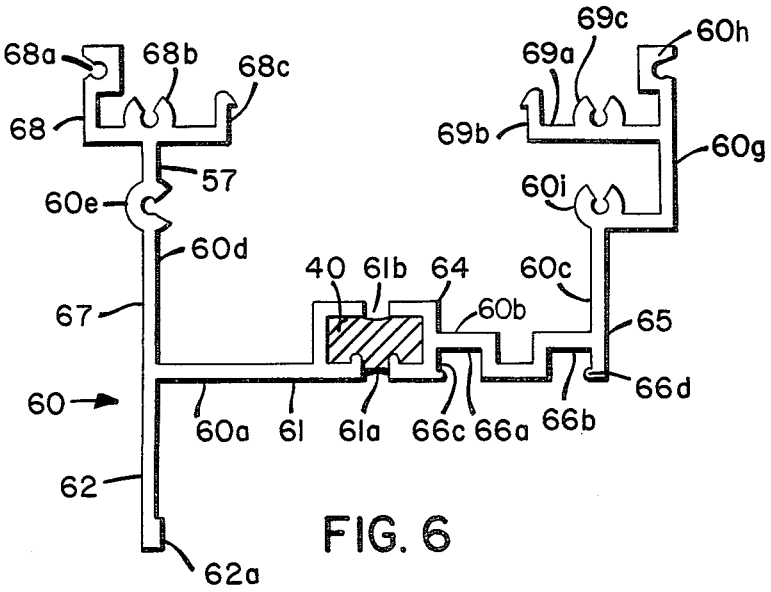
FIG. 6 is a sectional view of the head and sill member taken along the lines 6—6 of FIG. 4.

As shown in FIG. 6, head and sill member 60 has a substantially U-shaped profile in right cross section and includes an inner side 61, an outer side 63, an interior side 65 and an exterior side 67. The head and sill member 60 comprises a base 58 formed of two segments, an exterior segment **60*a* and an interior segment 60*b*, separated by an axial gap 61*a*. A pair of parallel legs 60*d* and 60*c* extend normal to and from the respective ends of base segments 60*a* and 60*b* respectively, while a flange 62 is formed normal to and extending from the end of the exterior base segment 60*a* in a direction opposite to the leg 60*d* and being coplanar therewith. It should be noted that flange 62 when extrusion formed and first cut to length, is of the same length as the member 60. It will be necessary, however, to cut away part of the flange 62 at both its ends for a distance sufficient to allow for its mating with the respective flanges of the pair of vertical jamb adaptors 80 hereafter more fully described. Head and sill member 60 is also provided with a central U-shaped channel 64 whose walls, as originally extrusion formed, bridged the axial gap 61*a* and thus provided the interconnecting link between base segments 60*a* and 60*b*. Channel 64 is shown filled with a material 40 of low thermal conductivity that was allowed to harden in place, and with a strip of its wall opposite to the axial gap 61*a* being removed by machining as at 61*b***. A pair of securing channels i.e., mortises, 66*a* and 66*b* are formed on the inner side 61 of the interior segment 60*b* of base 58. These securing channels 66*a* and 66*b* are designed, as by a depression 66*c* and by a slight protrusion 66*d* formed respectively therein, to accommodate in a snap-in fashion a glazing head 70*a* as will be more apparent hereafter. A pair of semi-circular ribs 60*e* and 60*i* are each formed in the respective pair of legs 60*d* and 60*c* equidistantly from the base 58. These ribs 60*e* and 60*i*, in addition to providing added structural strength to member 60 may be internally threaded at the respective ends of member 60 to receive screws by means of which member 60 may be secured to and within the pair of vertical side jambs 50, 50, more particularly through holes 46 formed therein, as may be best observed in FIG. 4. If self-tapping screws are used, then ribs 60*c* and 60*i* as well as the other ribs will not be internally threaded. Exterior leg 60*d* is provided with a short extension 57 coplanar therewith on which is formed an L-shaped portion 68 having a mortise 68*a* and a further semi-circular rib 68*b* which may also be internally threaded at the member's 60 respective ends, and an interior leg 68*c*. Ribs 68*b* and 60*e* are not only parallel to each other but are also in the same vertical plane. The interior leg 60*c* at its junction with rib 60*i* first has a horizontal shoulder portion 60*f*, followed by a vertical portion 60*g* also terminating in a mortise 60*h* which is both parallel with and being in the same plane as mortise 68*a*. A horizontal leg portion 69*a* is formed inwardly from vertical portion 60*g* terminating in a vertical leg 69*b*, and also accommodating a further semi-circular rib 69*c* parallel and coplanar with rib 60*i*, and also internally threaded at its ends. Finally, it should be noted that flange 62 is provided with a thickened portion 62*a* for better securing the abutting top rail 26 when the window is assembled.

Figure 7:
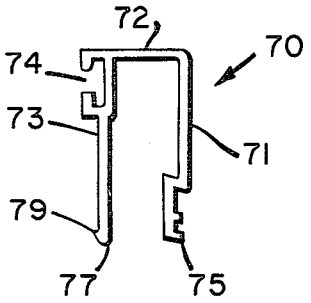
FIG. 7 is a sectional view of a glazing bead taken along the lines 7—7 of FIG. 4 but not including its vinyl bulb.
Figure 7A:
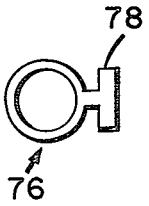
FIG. 7*a* is a sectional view of the vinyl bulb designed to fit into the mortise of the glazing bead shown in FIG. 7.

As shown in FIG. 7, glazing bead 70 has a substantially U-shaped profile in right cross section and comprises a base 72 and a pair of parallel legs 71 and 73, with leg 71 being the interior and leg 73 being the exterior leg. Interior leg 71 terminates in a beveled end 75, while exterior leg 73 terminates in a tapered end 77 and having a sharp ledge 79. Considering these ends 75 and 77 as tenons, they provide for snap-fit removable and rapid connection with and to the securing channels 66*a* and 66*b* of head and sill member 60, which securing channels 66*a* and 66*b* may then be considered as mortises for the tenons. It should be noted that beveled end 75 will accomodate itself within channel 66*a* held therein within depression 66*c*, while tapered end 77 will accomodate itself within channel 66*b* with its sharp ledge 79 frictionally engaging the protrusion 66*d* formed in channel 66*b*. Glazing bead 70 is furthermore provided with a mortise 74 of its own to removably accomodate therein a vinyl bulb 76 of tubular construction and having an integral T-shaped leg 78, as may be best observed in FIG. 7*a*, complementarily and slidably fitting into the mortise 74. This deformable bulb 76, which may also be extrusion formed, is intended to bear against the interior surfaces of the rails 26, 28, 36 or 38 as the case may be, not only securely to hold the glass panels contained therein, but also to provide an added thermal insulating barrier between the metallic parts of the rails and glazing beads.

Figure 8:
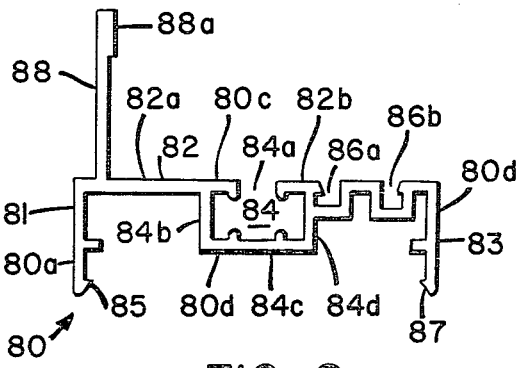
FIG. 8 is a sectional view of the left vertical jamb adaptor taken along the lines of 8—8 of FIG. 4 but showing the jamb adaptor as it appeared when extrusion formed and before its central U-shaped channel was filled with a material of low thermal conductivity.

As shown in FIG. 8, jamb adaptor 80 has a substantially U-shaped profile in right cross section and includes an exterior side 80*a*, an interior side 80*b*, an inner side 80*c* and an outer side 80*d*. Jamb adaptor 80 comprises, when extrusion formed as shown, a base 82 formed of an exterior segment 82*a* and an interior segment 82*b*, with an axial gap 84*a* therebetween, a pair of parallel legs 81 and 83 formed normal to the base 82 and terminating in beveled ends 85 and 87 respectively, a flange 88 also extending normal to the base 82 from its exterior segment 82*a* but in a direction opposite to that of the pair of legs 81 and 83 and offset from the exterior leg 81, the flange being provided at its free end with a reinforced portion 88*a* designed securely to hold the exterior surface of one of the vertical side rails 36 or 38. Jamp adaptor 80 further comprises a central U-shaped channel 84 whose walls 84*b*, 84*c* and 84*d* effectively bridge the gap 84*a* and thus provide the interconnecting link between the two base segments 82*a* and 82*b*, and a pair of securing channels 86*a* and 86*b*, i.e., mortises, formed in the interior segment 82*b* of base 82. It will be readily apparent to the trained eye that these channels 86*a* and 86*b* are much like channels 66*a* and 66*b* in that they also act as mortises for the tenons represented by the ends 75 and 77 of glazing bead 70 so as to securely hold the glazing bead 70 therein in a manner that its vinyl bead 76 faces toward the flange 88. Furthermore, it should be noted that the jamb adaptor 80 depicted in FIG. 8 is as when extrusion formed, like jamb 52 shown in FIG. 5A, since its channel 84 still has not been filled with a material 40 of low thermal conductivity nor has a strip of its extruded wall portion 84*c* been removed, both of which operations will be required before the jamb adaptor is ready for use as a structural component part of the thermal-break window 10 of the invention. It should be noted that beveled ends 85 and 87 of the pair of legs 81 and 83 respectively form a mortise therebetween so as to mate with appropriately formed tenons represented by the pair of projections 31 and 33 formed on the jambs 50, 50 so as to be conveniently and removably snap-fitted thereto, with the beveled ends 85 and 87 coming to rest in the side depressions 35 and 37 respectively formed in the projections 31 and 33, as previously described.

Figure 9:
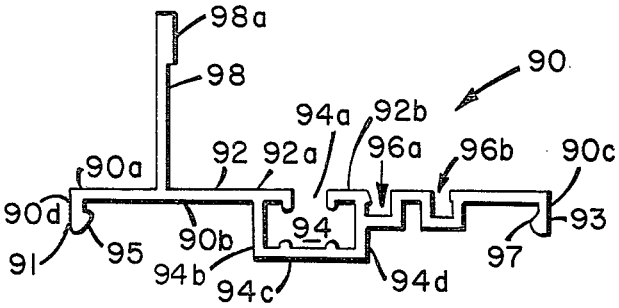
FIG. 9 is a sectional view of the head and sill adaptor taken along the lines of 9—9 of FIG. 4 but showing it as it appeared when extrusion formed and before its central U-shaped channel was filled with a material of low thermal conductivity.

As shown in FIG. 9, head and sill adaptor 90, as extrusion formed, has a substantially L-shaped profile in right cross section and includes an inner side 90*a*, an outer side 90*b*, an interior side 90*c* and an exterior side 90*d*. It comprises a base 92 formed of an exterior segment 92*a* and an interior segment 92*b* separated by gap 94*a*. A pair of shoulders 91 and 93 are formed at the exterior and interior ends of the base segments 92*a* and 92*b* respectively, and are each being provided with a projecting rib 95 and 97. A flange 98, having a reinforced portion 98*a*, extending normal to and from the exterior base segment 92*a* offset from the exterior side 90*d*, and a central U-shaped channel 94 whose walls 94*b*, 94*c* and 94*d* bridge the gap 94*a*, forms the interconnecting link between the base segments 92*a* and 92*b*. The interior base segment 92*b* is provided with a pair of securing channels 96*a* and 96*b* that function as mortises, in the same fashion as do securing channels 86*a* and 86*b*, for the tenons as represented by the ends 75 and 77 of glazing bead 70 so as to securely hold the glazing bead 70 therein in a manner that its vinyl bulb 76 faces toward the flange 98, with bottom rail 28, holding the insulating glass, accomodated between flange 98 and vinyl bulb 76. It should again be noted that head and sill adaptor 90 as shown in FIG. 9 is, like jamb 52 shown in FIG. 5A, not yet ready for assembly into a thermal-break window 10 until first its channel 94 has been filled with a material 40 of low thermal conductivity and a strip of the extruded channel wall 94c opposite to the gap 94a has been removed as by machining, so as to effectively separate head and sill adaptor 90 into two sections along its entire length, representing exterior and interior sections, that remained joined only by the material 40 hardened in place.

Figure 10:
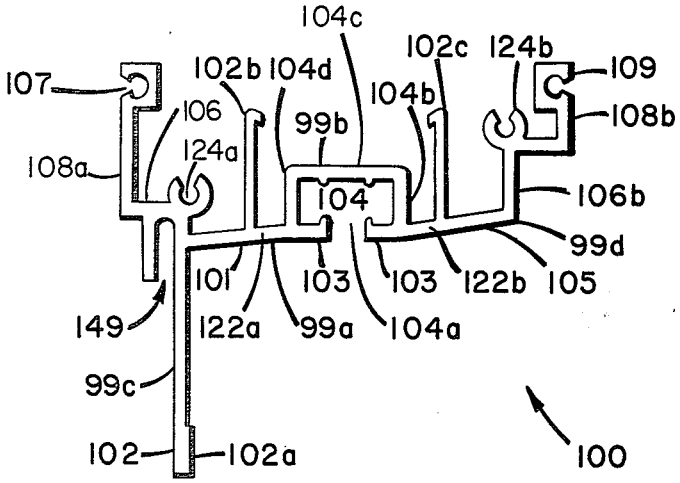
FIG. 10 is a sectional view of the frame sill taken along the lines of 10—10 of FIG. 4 but showing it as it appeared when extrusion formed and before its central U-shaped channel was filled with a material of low thermal conductivity.

As shown in FIG. 10, frame sill 100 has a substantially U-shaped profile in right cross section and includes an inner side 99a, an outer side 99b, an exterior side 99c and an interior side 99d. It comprises, when extrusion formed, a base 122 consisting of an exterior segment 122a and an interior segment 122b separated by a gap 104a. Frame sill 100, though similar to head and sill member 60, is designed to form the top horizontal member for a hopper-style window 14 which opens in at the top, as may be best observed in FIGS. 1 and 4. As a consequence, its base 122 is formed only at its central section 103 on each side of gap 104a at an angle which is normal to its flange 102, while its exterior section 101 defines an angle to its flange 102 which is somewhat greater than 90°, and its interior section 105 defines an angle which is greater still than 90° so as to facilitate the opening and closing of window section 14, particularly its top rail 146 thereof.

Frame sill 100 is also provided with a central U-shaped channel 104 whose walls 104b, 104c and 104d bridge the gap 104a, providing thus the interconnecting link between base segments 122a and 122b, when extrusion formed. A shoulder 106 is formed substantially at the junction of flange 102 and exterior base segment 122a and accomodates a semi-circular rib 124a which may be internally threaded at the ends of accomodate a screw by which it may be secured at both ends of the pair of vertical side jambs 50, 50, in the same manner as head and sill member 60. Shoulder 106 is furthermore provided with a reinforcing flange 106a parallel to and extending in the same direction as flange 102, although for a shorter distance and forming a channel 149 therebetween, and with an exterior wall 108a also parallel to flange 102 but extending in a direction opposite thereto and terminating in a mortise 107. An L-shaped portion 106b is formed at the end of the interior base segment 122b carrying at its elbow a further semi-circular rib 124b which may also be internally threaded at the ends to accomodate a screw by which frame sill 100 may be secured at both ends to the apir of vertical side jambs 50, 50. L-shaped portion 106b also carries interior wall 108b which is parallel to exterior wall 108a and also terminates in a mortise 109 being coplanar with mortise 107. It is to be noted that mortises 107 and 109 are designed to permit the snap-fitting of the head and sill adaptor 90 to the frame sill 100, with projecting ribs 95 and 97 serving as tenons upon entering mortises 107 and 109, respectively. Flange 102 is also provided with a reinforced portion 102a against which a vinyl weatherstripping provided on the exterior surface of top rail 146 presses when the window section 14 is closed. A pair of further reinforcing ribs 102b and 102c may also be provided to give further structural strength to the frame sill 100.

Figure 11:
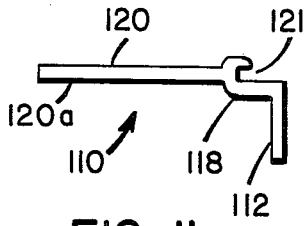
FIG. 11 is a sectional view of a glazing leg taken along the lines of 11—11 of FIG. 4.

As shown in FIG. 11, glazing leg 110 has a substantially L-shaped profile in right cross section and comprises a base 112 and a flange 120 being normal thereto and connecting therewith through an adjoining portion 118 also defining a channel 121 designed to accomodate therein the exterior projection 131 which preferably is formed integral with the vertical side jamb 50, as may be best observed in FIG. 4. A pair of holes 114 formed in base 112 cooperate with a pair of holes 116 formed in side jamb 50 to accomodate a pair of fasteners, such as screws, by means of which glazing leg 110 may be secured to the jamb 50. Flange 120 is also provided with a reinforced portion 120a against which a vinyl weatherstripping provided in a suitable recess formed in the exterior surfaces of vertical side rails 144a and 144b may press to effect a substantially air and water-tight closure therewith.

Figure 12:
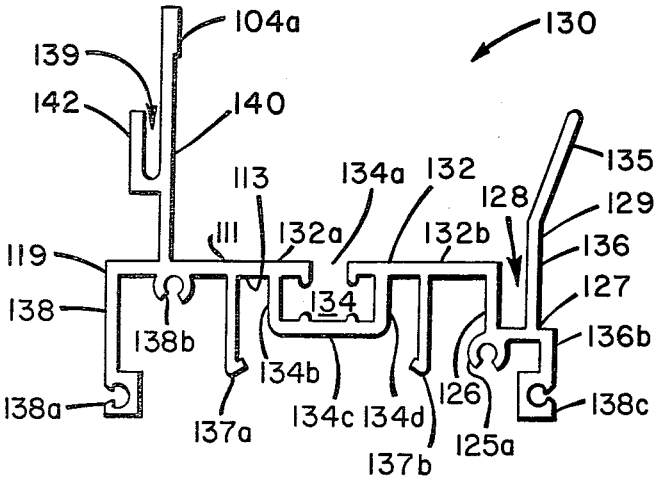
FIG. 12 is a sectional view of the frame head taken along the lines of 12—12 of FIG. 4 but showing it as it appeared when extrusion formed and before its central U-shaped channel was filled with a material of low thermal conductivity.

As shown in FIG. 12, frame head 130 has a substantially U-shaped profile in right cross section and includes an inner side 111, an outer side 113, an exterior side 119 and an interior side 129. Frame head 130 comprises, when extrusion formed, a base 132 formed of an exterior segment 132a and an interior segment 132b separated by a gap 134a, a central U-shaped channel 134 whose walls 134b, 134c and 134d bridge the gap 134a, thus providing the interconnecting link between segments 132a and 132b. Exterior segment 132a is provided at its end with an exterior wall 138 terminating in a mortise 138a, and with a flange 140 offset from the exterior side 119 and formed normal to the base 132, and having a reinforced portion 140a. Flange 140 is also provided with a parallel portion 142 defining a channel 139 therebetween. At the junction of flange 140 and base 132 and on the outer side 113 of frame head 130 is provided a semi-circular rib 138b whose respective ends may be internally threaded (unless self-tapping screws are used) to accomodate screws by which the ends of the frame head 130 may be securely fastened to the pair of vertical side jambs 50, 50. An L-shaped portion 126 formed at the interior end of the interior base segment 132b carries a further semi-circular rib 125a whose respective ends are also preferably internally threaded for the same purpose as rib 138b, and also carries an interior wall 136 which is parallel with exterior wall 138 but extends in the direction of flange 140 and defines a channel 128 between wall 136 and the vertical part of the L-shaped portion 126. This channel 128 is designed to accomodate the larger internal segment of bottom rail 148 when the hopper-style window section 14 is closed, making for a stronger closure therewith. Offset by shoulder 127, L-shaped portion 126 also is provided with a further interior wall 136b also parallel with and extending in the same direction as exterior wall 138 and terminating in a mortise 138c being coplanar with mortise 138a, by means of which a vertically succeeding window section may be joined thereto, if desired. Again to facilitate the opening and closing of hopper-style window section 14, interior wall 136 is provided with an inclined portion 135 that forms an angle with the base 132 which is greater than 90°. To give the frame head 130 added structural strength, a pair of reinforcing ribs 137a and 137b may also be provided in the outer side 113 of head 130. And to cushion the seating of window section 14 when closed, a plurality of soft plastic sponges 115, observe FIG. 4, may be adhesively bonded to the inner side 111 of exterior base segment 132a. The channel 139 formed in flange 140 of frame head 130 cooperates with the channel 149 formed in the flange 102 of frame sill 100 to accomodate therein a suitable screen, if desired, to keep the insects out when the hopper-style window section 14 is in the open position. It should be understood that before frame head 130 may be used in the thermal-break window 10 of the invention, its central U-shaped channel 134 will have to be filled with a material 40 of low thermal conductivity and a stripe of its wall 134c removed, as by machining, preferably opposite to the gap 134, so as to separate the frame head 130 into two sections along its entire length, representing exterior and interior sections, that remain joined only by the material 40 of low thermal conductivity, thermally insulating thereby the exterior from the interior sections.

As previously indicated, the extruded frame members of the thermal-break window 10 of the invention are easily assembled since certain of the members are designed to snap-fit to each other. In order to assemble a window 10 as shown and described with reference to FIG. 1 and 4 herein, consisting of a top fixed window section 12 and of a bottom hopper-style window section 14, insulating glass of the kind composed of two panels 11 and 13 and 141 and 143 respectively, with an air space sealed therebetween, is secured within rails 26, 28, 36 and 38 in the case of the former and within rails **146, 148, 144*a* and 144*b* in the case of the latter. Then, vertical side jambs 50, 50 are each snap-fitted with their jamb adaptors 80, 80 and vertical glazing beads 70*b* and 70*d* are snap-fitted to their respective jamb adaptors 80, 80 while the bottom horizontal head and sill adaptor 90 is snap-fitted to the horizontal frame sill 100, and the horizontal glazing bead 70*c* is snap-fitted to the head and sill adaptor 90**, with the respective tenons of the parts being inserted within their corresponding respective mortises on the adjoining parts, all as above described when describing in detail the shape and construction of these parts.

The bottom rail 28 carrying the insulating glass composed of panels 11 and 13 is then inserted within the flange 98 of head and sill adaptor 90 and the vinyl bulb 76 of the horizontal glazing bead **70*c*. This assembly may then be joined on its vertical sides by the previous subassemblies comprising the vertical side jambs 50, 50, their respective jamb adaptors 80, 80 and their respective vertical glazing beads 70*b* and 70*d* so as to slidably secure the vertical rails 36 and 38 within the respective channels formed by the flanges 88 of jamb adaptors 80 and the vinyl bulbs 76 previously disposed within their mortises 74 formed in the glazing beads 70*b* and 70*d*. Once these parts are properly fitted to one another and assembled, a pair of screws will be screwed in through appropriate holes 46 formed in the side jambs so as to enter, from both the left and the right-hand side, the internally-threaded semi-circular ribs 124*a* and 124*b* formed in the frame sill 100, as was more fully described with reference to FIG. 10 herein. With this operation completed, the top fixed window section 12 is secured within the pair of vertical side jambs 50, 50 from three sides and only its top horizontal rail 26 need be secured by the top horizontal head and sill member 60 and its snap-fitted horizontal glazing bead 70*a*. More particularly, top rail 26 will be accomodated in the channel formed between the flange 62 of head and sill member 60 on the exterior side and the vinyl bulb 76 slidably fitted within the mortise 74 of the top glazing bead 70*a*, on the interior sides as already mentioned. With head and sill member 60 and its snap-fitted glazing bead 70*a* securely in place within the vertical side jambs 50, 50 and surrounding the top rail 26, the head and sill member 60 may now be secured to the side jambs 50, 50 by at least a pair of screws from both the left and right hand side and preferably by four screws from each side, admitted through holes 46 formed in the side jambs 50 and entering into the internally-threaded ends of the semi-circular ribs 60*e*, 60*i*, 68*b* and 69*c* formed in the head and sill member 60, as hereinabove more fully described with reference to FIG. 6. The top fixed window section 12** is thus firmly secured within its extrusion formed frame members.

With respect to the bottom hopper-style window section 14, the insulating glass composed of glass panels 141 and 143 with an air space sealed inside, is first secured within its rails **146, 148, 144*a* and 144*b*. The two vertical L-shaped legs 110, 110 are secured to their respective vertical side jambs 50, 50 by screws, in a manner already described, making sure that the exterior projections 131 formed on the side jambs 50 are fitted within the channels 121 of the glazing legs 110. The flanges 120 of glazing legs 110, together with the flange 102 of the top horizontal frame sill 100 and flange 140 of the bottom horizontal frame head 130, will provide one of the double-contacts by which the window section 14 is provided so as to achieve continuous weathering between the frame and the window section. The other one of the double-contacts is effected by the L-shaped rails 146,148, 144*a* and 144*b* fitting snugly against the interior faces formed by the interior vertical projections 133 formed on the side jambs 50, 50 and against the vertical interior side of the L-shaped portion 106*b* of the top horizontal frame sill 100. The bottom rail 148, as previously mentioned, is designed to fit within the channel 128 formed by L-shaped portion 126 and interior parallel wall 136 of the bottom horizontal frame head 130**. It is to be understood that both of these double-contacts are provided with extruded vinyl weatherstripping held securely within special recesses formed in the extruded metal frame members, all as well understood by those skilled in the art.

Next, the balance arms 16 having adjustable sliding pivots with non-abrasive friction shoes and concealed adjustable compression springs may first be conveniently secured onto each inner side of the vertical side jambs 50, 50 by appropriate screws or nuts and bolts, all as is well known and understood by those skilled in the art. Then the free ends of the balance arms 16 may be secured to the respective vertical outer sides of the side rails **144*a* and 144*b* by securing the mounting strips 150 thereto with nuts 145 and bolts 147, as previously mentioned. Finally, the bottom horizontal frame head 130 is secured in place within the vertical side jambs 50, 50 by a pair of screws passing through holes 46 from the outer sides of each side jamb 50, becoming anchored within the internally-threaded ends of semi-circular ribs 138*b* and 125*a* of frame head 130, as already described with reference to FIG. 12. The thermal-break window 10 of FIG. 1** is now ready to be secured within a wall of a building.

Figure 2:
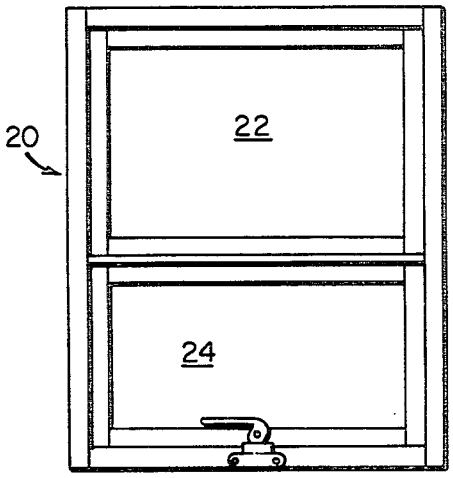
FIG. 2 is a front elevation of a thermal-break window of the invention and consisting of a top fixed window section and of a bottom project-out ventilator window section.
Figure 3:
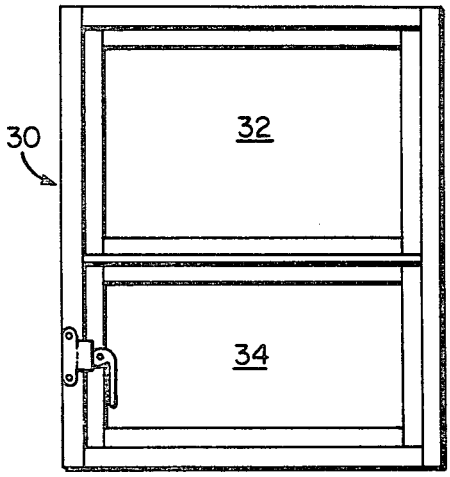
FIG. 3 is a front elevational of a thermal-break window of the invention and consisting of a fixed window section and of a bottom casement-style window section.

It is to be understood that various other modifications and embodiments of thermal-break windows are possible, for instance, the window may comprise a plurality of fixed window sections, with or without a plurality of ventilator-type window sections, be they of the hopper-style or of the project-out style 24 shown in FIG. 2, or of the casement-style 34 shown in FIG. 3, or of any combinations thereof.

Since certain changes may be in the foregoing disclosure without departing from the scope of the invention herein involved, it is intended that all matter contained in the above description and depicted in the accompanying drawings be construed in an illustrative and not in a limiting sense.

What is claimed is:

1. A window of the type in which the frame encasing the glass panel is provided with a thermal-break and comprising a pair of side jambs and adaptors, a head and top and bottom sill members, and a plurality of glazing beads interconnected to form a substantially rectangular frame for encasing a glass panel secured within a plurality of rails in which each said jambs, adaptors, head and sill members are extrusion formed of metal with a channel along their respective axial lengths, said channel containing an elastomeric material of low thermal coefficient and with a strip of the extruded metal material along said channel being removed, effectively separating each of said extruded parts into two sections along their entire lengths, representing exterior and interior sections, that remain joined only by said material of low thermal coefficient, thermally insulating thereby said exterior from said interior sections, said adaptors designed to snap-fit to said side jambs, a pair of said plurality of glazing beads designed to snap-fit to said adaptors, a second pair of said plurality of glazing beads designed to snap-fit to said top and bottom sill members, each of said plurality of glazing beads provided with a mortise removably to accommodate therein a deformable bulb of tubular construction having a T-shaped leg fitting into said mortise, said deformable bulbs designed to bear against the surfaces of said plurality of rails securing said glass panel therein, said deformable bulbs resiliently holding said glass panel and also providing an additional thermally insulating barrier between said exterior and said interior sections.

2. The window of claim 1 which is a fixed window.

3. The window of claim 1 which is a hopper-type window.

4. The window of claim 1 which is a casement-type window.

5. The window of claim 1 which consists of at least one fixed window section and of at least one ventilator-type window section.

6. A composite window of the type including at least one fixed window section and at least one ventilator-type window section and comprising a pair of side jambs and adaptors, a head and top and bottom sill members, a plurality of glazing beads surrounding said fixed window section and a pair of vertical side glazing legs about said ventilator-type window section, all interconnected to form a substantially rectangular frame for encasing a first glass panel secured within a plurality of rails in said fixed window section and a second glass panel secured within a plurality of rails in said ventilator-type window section, and a head and sill adaptor designed to separate said fixed window section from said ventilator-type window section, in which each said jambs, adaptors, head and sill members and said head sill adaptor are extrusion formed of metal with a channel along their respective axial lengths, said channel containing an elastomeric material of low thermal coefficient and with a strip of the extruded metal material along said channel being removed, effectively separating each of said extruded parts into two sections along their entire lengths, representing exterior and interior sections, that remain joined only by said elastomeric material of low thermal coefficient, thermally insulating thereby said exterior from said interior sections, in which said extrusion formed metal members are designed to snap-fit into adjacent members and in which each of said plurality of glazing beads is provided with a mortise removably to hold therein a deformable bulb of tubular construction having a T-shaped leg fitting into said mortise, said deformable bulbs designed to bear against the surfaces of said plurality of rails receiving said first glass panel therein, said deformable bulbs resiliently holding said first glass panel and also providing an additional thermally insulating barrier between said exterior and said interior sections.

7. The composite window of claim 6 in which said ventilator-type window section is a hopper-type window.

8. The composite window of claim 6 in which said head and sill adaptor has a substantially L-shaped profile in right cross section comprising, when extrusion formed, a base formed of an exterior and of an interior segment separated by a gap, a pair of shoulders formed at said base segments and being each provided with a rib, a flange extending normal to and from said exterior base segment, a central U-shaped channel whose walls bridge said gap, providing the interconnecting link between said two base segments, and a pair of securing channels formed in the interior segment of said base, said pair of securing channels designed removably to accommodate therein one of said plurality of glazing beads having said deformable bulb, with said fixed window section resiliently held between said flange and said deformable bulb of said one of said plurality of glazing beads.

9. The composite window of claim 6 in which both said first and second glass panel comprises insulating glass of the kind having an exterior and an interior panel with an air space sealed therebetween.

10. A thermal-break window of extruded metal frame members interconnected to form a substantially rectangular frame for encasing a glass panel formed of insulating glass having an exterior and an interior panel with an air space sealed therebetween in which each of said frame members is formed with a channel along its axial length, said channel containing elastomeric material of low thermal conductivity hardened in situ and with a strip of the extruded metal material along said channel being removed, effectively separating each of said extruded frame members into two sections along their entire lengths, representing exterior and interior sections, that remain joined only by said elastomeric material of low thermal conductivity, thermally insulating said exterior from said interior sections, said extruded frame members including a pair of side jambs and a pair of jamb adaptors designed to snap-fit to one another, each of said pair of side jambs having a substantially U-shaped profile in right cross section and comprising, when extrusion formed, a base formed of two segments with an axial gap therebetween, a pair of legs formed normal to said base, a central U-shaped channel whose walls bridge said axial gap, providing the interconnecting link between said two segments of said base, and a pair of projections, one from each said segments, normal to said base but in a direction opposite to that of said pair of legs and offset therefrom, with each of said projections being provided with side depressions along their lengths, and each of said pair of jamb adaptors having a substantially U-shaped profile in right cross section and comprising when extrusion formed, a base formed of two segments, exterior and interior, with an axial gap therebetween, a pair of legs formed normal to said base and terminating in beveled ends, a flange extending normal to said base from its exterior segment but in a direction opposite to that of said pair of legs and offset therefrom, a central U-shaped channel whose walls bridge said axial gap, providing the interconnecting link between said two segments of said base, and a pair of securing channels formed in the interior segment of said base.

11. The thermal-break window of claim 10 in which said extruded frame members further include a plurality of glazing beads, each of said glazing beads having a substantially U-shaped profile in cross section and comprising a base and a pair of parallel legs, with one of said legs terminating in a beveled end and the other of said legs terminating in a tapered end, said beveled and tapered ends designed to be accommodated within said pair of securing channels of one of said pair of jamb adaptors.

12. The thermal-break window of claim 10 in which said extruded frame members include a frame sill having a substantially U-shaped profile in right cross section comprising, when extrusion formed, a base formed of an exterior and of an interior segment separated by a gap, a central U-shaped channel whose walls bridge said gap, providing the interconnecting link between said two base segments, a flange extending from said exterior base segment and initially forming a greater than right angle therewith, followed by a central section of said base surrounding said gap which is normal to said flange, followed still further on its interior segment by a section forming a still greater than right angle to said flange, a shoulder formed at the junction of said flange and said exterior base segment and connecting to an exterior wall terminating in a retaining channel, and an L-shaped portion formed at the end of said interior base segment and connecting to an interior wall parallel with said exterior wall and also terminating in a second retaining channel.

13. The thermal-break window of claim 10 in which said extruded frame members include a head and sill member having a substantially U-shaped profile in right cross section comprising, when extrusion formed, a base formed of two segments, exterior and interior, with an axial gap therebetween, a pair of parallel legs extending normal to and from the ends of said base segments, a flange extending normal to and from the end of said exterior segment of said base in a direction opposite to that of one of said pair of parallel legs and being coplanar therewith, a central U-shaped channel whose walls bridge said axial gap, providing the interconnecting link between said two segments of said base, a pair of securing channels formed in the interior segment of said base, and a plurality of semi-circular ribs formed at the free ends of said pair of parallel legs, at least two of which are designed to receive fastening members securely to connect each of the ends of said head and sill members to abutting extruded frame members so as to form said substantially rectangular frame for said glass panel.

* * * * *